US008872605B2

(12) United States Patent
Kapfinger

(10) Patent No.: US 8,872,605 B2
(45) Date of Patent: Oct. 28, 2014

(54) CAVITY FILTER

(75) Inventor: Thomas Kapfinger, Ebbs (AT)

(73) Assignee: Kathrein-Austria Ges.m.b.H., Kufstein (DE)

( * ) Notice: Subject to any disclaimer, the term of this patent is extended or adjusted under 35 U.S.C. 154(b) by 429 days.

(21) Appl. No.: 13/377,923

(22) PCT Filed: Jun. 3, 2010

(86) PCT No.: PCT/EP2010/003366

§ 371 (c)(1),
(2), (4) Date: Jan. 18, 2012

(87) PCT Pub. No.: WO2010/145758

PCT Pub. Date: Dec. 23, 2010

(65) Prior Publication Data

US 2012/0105176 A1 May 3, 2012

(30) Foreign Application Priority Data

Jun. 18, 2009 (DE) ..... 10 2009 025 408

(51) Int. Cl.
*H01P 1/202* (2006.01)
*H01P 7/04* (2006.01)
*H01P 1/205* (2006.01)

(52) U.S. Cl.
CPC ..... *H01P 1/2053* (2013.01); *H01P 7/04* (2013.01)
USPC ..... 333/203; 333/206

(58) Field of Classification Search
USPC ..... 333/202, 203, 206–212, 230, 248
See application file for complete search history.

(56) References Cited

U.S. PATENT DOCUMENTS

| | | | | |
|---|---|---|---|---|
| 3,955,161 | A | 5/1976 | MacTurk | |
| 4,100,504 | A | 7/1978 | McGann | |
| 5,329,687 | A | 7/1994 | Scott et al. | |
| 6,078,231 | A * | 6/2000 | Pelkonen | 333/203 |
| 6,559,740 | B1 * | 5/2003 | Schulz et al. | 333/202 |
| 7,449,981 | B2 * | 11/2008 | Park et al. | 333/203 |
| 2002/0145490 | A1 | 10/2002 | Sauder et al. | |

FOREIGN PATENT DOCUMENTS

| | | |
|---|---|---|
| DE | 43 37 079 | 6/1994 |
| DE | 10 2006 030 634 | 1/2008 |
| DE | 10 2006 033 704 | 1/2008 |
| WO | WO 02/06686 | 1/2002 |
| WO | WO 2006/063640 | 6/2006 |

OTHER PUBLICATIONS

International Search Report for PCT/EP2010/003366, mailed Sep. 22, 2010.

* cited by examiner

*Primary Examiner* — Robert Pascal
*Assistant Examiner* — Kimberly Glenn
(74) *Attorney, Agent, or Firm* — Nixon & Vanderhye P.C.

(57) ABSTRACT

The invention relates to an improved HF cavity filter characterized by the following features: the housing cover (17) is made of a circuit board (21); the at least one additional hole (29) is made in the circuit board (21), in which a tuning bushing soldered at the outer circumference to an electrically conductive layer (25) on the circuit board is inserted; the tuning element (37) can be threaded to a varying depth into the tuning bushing (31); at least one electrically conductive structure is implemented on the circuit board (21); and the dielectric conductive structure comprises at least one conductor and/or at least one SMT component and/or at least one HF overcoupling device.

10 Claims, 2 Drawing Sheets

CAVITY FILTER

This application is the U.S. national phase of International Application No. PCT/EP2010/003366, filed 3 Jun. 2010, which designated the U.S. and claims priority to DE Application No. 10 2009 025 408.0, filed 18 Jun. 2009, the entire contents of each of which are hereby incorporated by reference.

The invention relates to a cavity filter according to the pre-characterising clause of Claim 1.

In radio systems, in particular in the mobile communication field, a common antenna is often used for transmitted and received signals. In this case the transmitted or received signals use different frequency ranges, and the antenna must be suitable for transmitting and receiving in both frequency ranges. Therefore, to separate the transmitted and received signals, suitable frequency filtering is necessary, in which on the one hand the transmitted signals are passed on from the transmitter to the antenna, and on the other hand the received signals are passed on from the antenna to the receiver. To separate the transmitted and received signals, nowadays high frequency filters in coaxial construction are used, among other things.

High frequency cavity filters in coaxial construction include coaxial resonators, in which resonator cavities are formed in an outer conductor housing, inner conductors in the form of inner conductor tubes being arranged in the cavities. The inner conductor tubes each have a free end, which is adjacent to a housing cover, which is on the top of the housing.

A high frequency filter has become known from, for example, WO 2006/063640 A1. In this case the generic high frequency filter can consist of multiple resonators, each of which includes an outer conductor housing, a housing floor and an inner conductor which is preferably arranged coaxially to the outer conductor, and which usually ends at a distance below the housing cover, which can be placed on the housing.

As is known, such high frequency filters, also called HF filters for short below, are manufactured from a metal housing, usually an aluminium housing, e.g. in the form of a milled part or casting, so that no intermodulation problems because of points of impact in the filter occur. The housing cover is also usually manufactured from a metal, i.e. a milled part or casting, e.g. of aluminium, the housing cover also preferably being silvered, to achieve good electrical ability to contact the housing.

The housing cover is provided at its surrounding edge with a row of holes, which align with corresponding threaded holes in the housing walls of the high frequency filter, so that by turning screws the housing cover can be fitted firmly on the actual housing, to ensure high-frequency-proof fitting of the cover in this way.

A high frequency filter of a new type has become known from U.S. Pat. No. 3,955,161 A, for example. It describes a housing construction with multiple high frequency chambers with inner conductors which rise from the floor in the direction of the cover. Both the high frequency filter housing and the high frequency filter cover which seals the high frequency filter housing consist of plastics material. Both consist of a plastics material housing. All surfaces of the HF housing and HF cover are coated inside and outside with an electrically conductive layer.

In the high frequency cover itself, in corresponding holes, there are screws which can be screwed in to different distances, the screw shanks aligning axially with the inner conductors which are arranged in the high frequency filter. Thus by screwing the screws in and out, the effective distance between the forward face of the screw shank and the opposite face of the inner conductor can be enlarged or reduced, so that a corresponding high frequency filter can be tuned in a known manner.

A high frequency filter has in principle also become known from U.S. Pat. No. 5,329,687 A. This HF filter too includes an HF housing and an HF cover, which in turn consist of a cast dielectric material, which was then coated with an electrically conductive layer. In this case too, tuning screws, which via corresponding holes in the HF cover can be screwed in or out to different distances and in this way dip by different amounts into a correspondingly axial recess in an inner conductor of the HF housing below them, are used. In this way too, the HF filter can again be tuned in a known manner.

Additionally, from DE 10 2006 030 634 A1, an oscillator arrangement should be taken as known. This has an integrated circuit and an external frequency-determining resonator, the frequency-determining resonator being set up as a cavity resonator, and as well as its electrical function acting as a housing and support for the integrated circuit of the high frequency oscillator.

Likewise, from US 2002/145490 A1, a cavity filter should be taken as known which includes a box-shaped housing comprising side walls and a floor, the opening on top of said housing being sealed by a plate-shaped cover. The individual cavity resonators, which are separated from each other by partition walls, are provided inside the housing. According to this prior publication, the cavity resonators should be produced by extrusion or casting, one or more walls of the filter arrangement being formed from a printed circuit board material. The remaining walls should be produced in a conventional manner, which is not specified in greater detail.

Finally, a cavity filter arrangement has also become known from WO 02/06686 A1. This document discloses a cavity filter which likewise has a box-shaped structure comprising a floor, side walls and a cover arranged on top. In this context, a certain choice of material for the housing was not suggested.

This prior publication relates to a specific object, namely how the screwing in behaviour of a thread element as a tuning element of the cavity resonator can be improved. A tuning sleeve is inserted into the cover of the cavity filter for this purpose, and can be fixed into the cover by pressing or soldering or by other means. In its axial alignment, the tuning sleeve comprises two inner thread regions offset from each other, which do not exactly correspond to the outer thread of the tuning sleeve which can be screwed in here. Preferably, the thread sleeve is provided with two grooves running radially to said thread sleeve at axial distance, which make possible a relative change in position, in the axial alignment, of the thread portions by which the screwing in and screwing out behaviour of the tuning element is changed.

In contrast, the object of the present invention is to create an improved high frequency filter, which usually includes a housing and a cover which seals the housing interior.

The invention is achieved according to the features given in Claim 1. Advantageous versions of the invention are given in the subclaims.

It should also be considered extremely surprising that within the invention it has become possible, through the interaction of various properties, to create a cavity filter that has greatly improved passive intermodulation properties in comparison to conventional cavity filters.

Within the invention, it has been shown that, for example, despite silvering an aluminium cover of an HF filter, a not yet sufficiently optimal, evenly reproducible mechanical and above all electrical connection between the cover and the housing is achievable.

Thus the known cavity filters according to the prior art continue to have certain intermodulation problems.

Within the invention, it has now been shown that a clear improvement can be achieved, above all in relation to the electrical properties, with simultaneous cost reduction, if as in the prior art the starting point is a cavity filter housing which includes a cover of a printed circuit board material.

The printed circuit board material is provided with an electrically conductive layer, preferably a copper layer. The printed circuit board cover, like normal covers, is preferably fixed by screws to the housing walls of the cavity filter and connected electrically-galvanically to the housing, for which reason the electrically conductive layer preferably comes to lie with the housing interior of the cavity filter in the form of a copper layer plus an additional layer, which may be possible, as refinement, e.g. silver, gold or tin.

Because of the use of a printed circuit board as the cover, the result, because of the material, is a relatively soft conducting layer on the printed circuit board, preferably in the form of the above-mentioned copper layer, in which case, by screwing the cover onto the filter housing with an appropriate tightening torque, a 100% HF-proof connection can for the first time be ensured. Above all, the result in this way is a further cost saving, since a separately cast plastics material cover does not have to be produced and used, but instead printed circuit boards, which can be obtained very inexpensively on the market, are used directly as covers.

The use of printed circuit board material as the cover also opens up the possibility of carrying out SMT population of the board using SMT components (according to surface mounted technology) and with tuning elements, etc. In the prior art, these tuning elements were pressed into the aluminium cover. Here, according to the invention, a sleeve element provided with an inner thread can be inserted into the printed circuit board, into a corresponding hole, and for example inserted with a surrounding flange on the inside of the HF filter adjacent to the electrically conductive layer (i.e. soldered to it), and a tuning element provided with an outer thread can be screwed into said sleeve element to different distances into the cavity filter, to tune the filter correspondingly and/or to set a corresponding resonant frequency. Since the tuning socket, which is placed in a hole of the printed circuit board, is soldered to the electrically conductive layer which is formed on the printed circuit board, in this way intermodulation problems are also avoided.

Because in the prior art, here only screws which can be screwed directly into corresponding holes in the plastics material board, which is coated with an electrically conductive layer, are used, with the consequence that here definite electrical-galvanic contacting between screw and electrically conductive layer can never be ensured. This results in clear deterioration in the handling and practice of an HF filter constructed in this way.

Finally, it is shown as a further advantage within the invention that the printed circuit board material in the present method is provided with structuring, for example. The structuring can be in such a form that by it, for example, direct current (DC) lines, electronics which can be populated with the printed circuit board, HF overcoupling etc. can be achieved.

It is also essential within the invention that the electrically conductive mass surface which completely seals the coaxial resonator (balun/cavity resonator) on the top of the housing is a basic component of the cavity filter.

The invention is explained in more detail below on the basis of drawings. In detail:

Below, on the basis of an embodiment, the invention is described for a cavity filter, which can also for example be in the form of a duplex separating filter, band pass filter or band stop filter, etc.

According to the shown embodiment, the high frequency cavity filter 1, sometimes called the HF cavity filter 1 below, comprises a housing 3 with a floor 5 and multiple inner conductors 7 which extend vertically from the floor over a partial height of the housing 3.

In this way, finally a complete filter, consisting of multiple individual HF cavity filters 1", is created.

Figure 1:
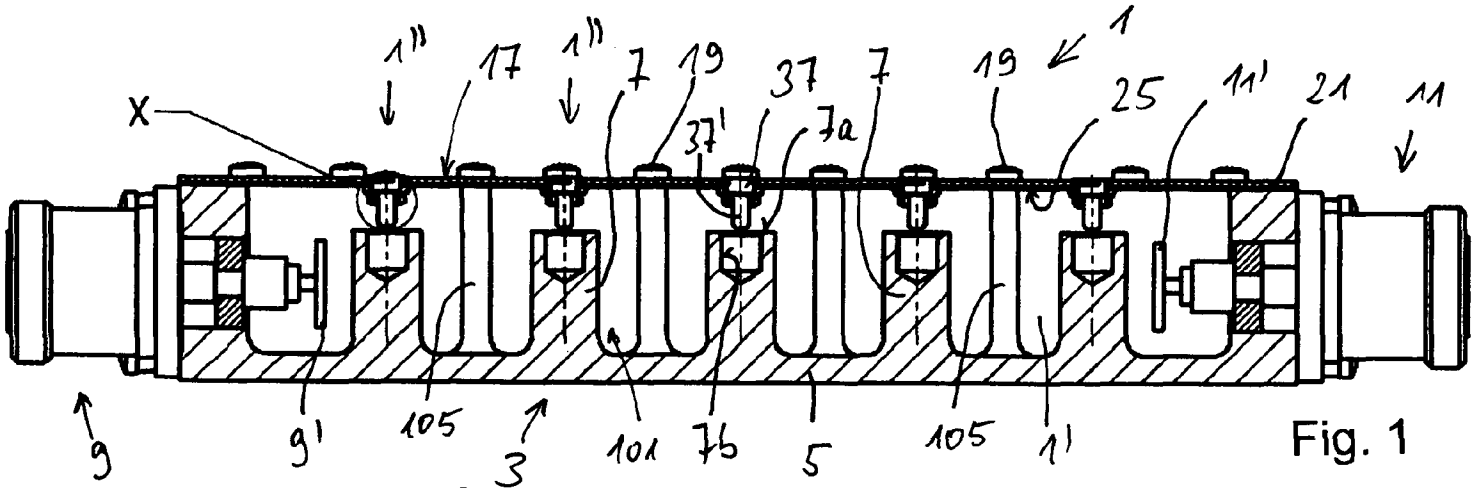
FIG. 1 is a cross-section through a cavity filter with multiple adjacently arranged (coupled) resonators with covers placed on them.
Figure 2:
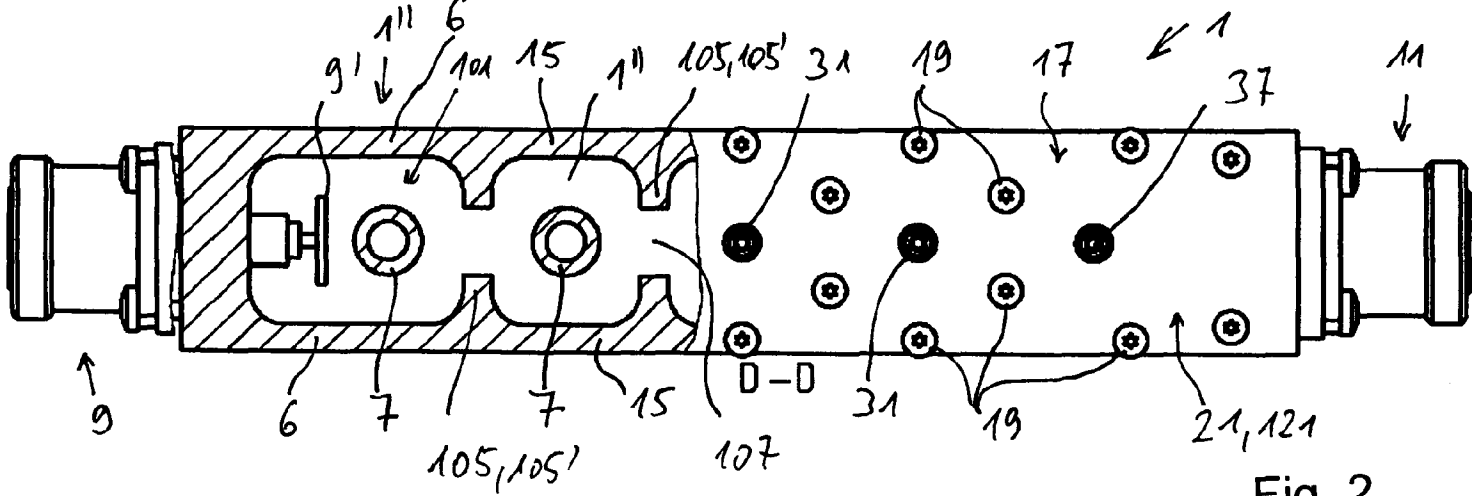
FIG. 2 is a plan view of the embodiment according to FIG. 1.
Figure 3:
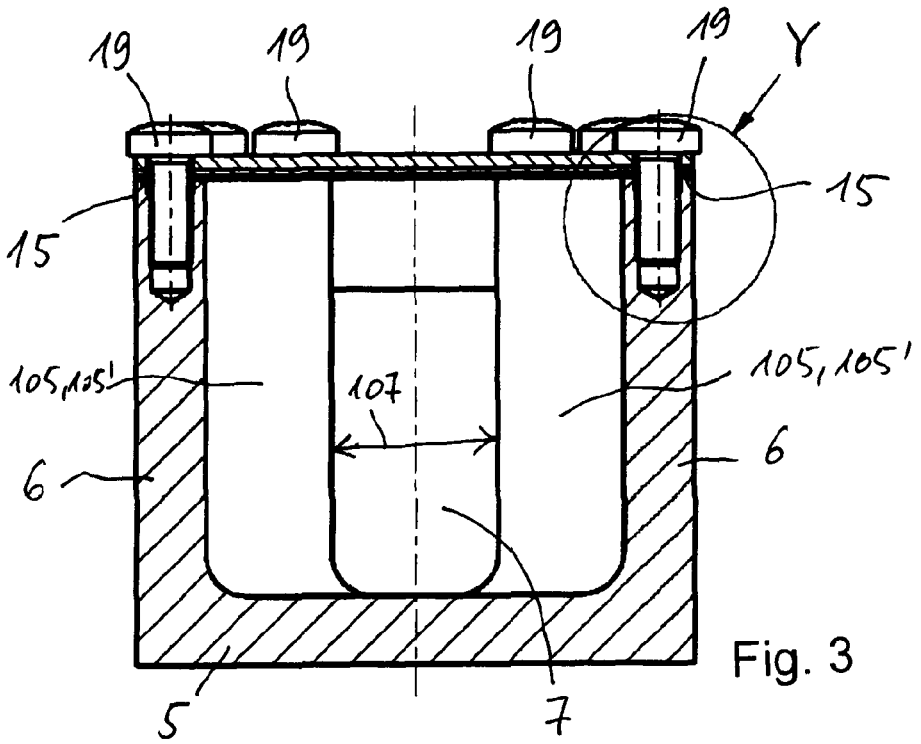
FIG. 3 is a cross-section through the embodiment according to FIGS. 1 and 2.

The individual HF cavity filters shown in FIGS. 1 and 2 (where the cover is partly omitted) are each divided into chambers 101, which are separated by boundary walls 105 from a nearest adjacent individual HF cavity filter 101, the boundary walls 105 each being formed from two wall sections 105' which project inward from the side wall sections 6. In this way, virtual screens or windows are formed between the only partly inward projecting wall sections, the individual HF filters 1" being coupled to each other via these screens or walls 107 (FIG. 3).

The cavity filter has, for example, an input connection in the form of a coupling-in region 9 and an output connection in the form of a coupling-out region 11, which includes or can include a coupling-in disc 9' (capacitive coupling-in) or a coil or wire (in the case of inductive coupling-in), the relevant coupling-in disc, coupling-in coil or coupling-in wire being designated inside by the reference symbols 9' and 11' for feeding in or coupling out respectively an electromagnetic wave. At the input or output connection, normal coaxial plugs with corresponding line connections can be connected.

The thus constructed housing 3 with the housing floor 5 and the inner conductor 7 is formed from a milled part or casting of metal or a metal alloy. Preferably, aluminium is used for this purpose. Since the inner conductor is integral with or screwed to the housing floor, in this way intermodulation problems are avoided.

On the surrounding edge 15 (FIG. 3) of the housing 3, facing away from the floor 5, a housing cover 17 is placed, and screwed firmly to the housing 3 with multiple screws 19.

In order to screen the individual HF cavity filters 1, i.e. the interior 1' of the HF cavity filters 1, outward to seal them against HF, the housing cover 17 consists of a printed circuit board 21, i.e. in general of a board material 121, which compared with the metal used for the housing, with the floor and with the housing walls 6 which are arranged surrounding the inner conductor, is at least slightly yieldable and/or at least slightly deformable. The result is that the copper layer 25 which is provided on the board material 121, compared with the traditional housing cover 17 made of metal, is softer, more flexible and/or more resilient, i.e. more easily deformable. Additionally, the thickness of the printed circuit board 21 and/or of the board material 121 can be significantly less than the thickness of the wall, floor or inner conductor of the HF cavity filter. Thus, for example, the thickness of the printed circuit board, as usual, can be less than 5 mm, in particular less than 4 mm, less than 3 mm and less than 2 mm, e.g. around 1 mm (and below). Usually, the minimum thickness will be about 1.0 mm, 0.8 mm, 0.5 mm, 0.1 mm or slightly above. As can be seen, for example, in the detailed cross-section according to FIG. 4, the total thickness of the printed circuit board and a conductive mass layer 25, which is explained below, can be around 1.5 mm, for example. This thickness D is drawn in FIG. 4, for example.

Favourable values for the electrically conductive layer of the printed circuit board, preferably in the form of copper, can be around 30 μm to 40 μm, e.g. around 35 μm. In general, the thickness of the electrically conductive layer can be, for example, 1 μm to 300 μm, in particular 2 μm to 200 μm, 3 μm to 2 μm or 10 μm to 50 μm, above all, as mentioned, 30 μm to 40 μm. In general, it can then be assumed that the thickness of the copper layer or the electrically conductive layer 25, 26 has, for example, a thickness which is less than 20%, in particular less than 10%, 8%, 6%, 4%, 2%, 1% or even less than 0.5% or 0.1% of the thickness of the associated printed circuit board 21. On the other hand, the thickness can also be chosen so that the copper layer is more than 0.1%, in particular more than 0.5%, 1%, 2%, 4%, 6%, 8%, 10% or more than 15% of the thickness of the printed circuit board 21. In other words, therefore, thickness ranges of 1% to 5% of the thickness of the printed circuit board 21 are specially favourable.

On the side facing the housing 3, i.e. on the inside or underside 21*a* (i.e. the housing interior) facing the interior 1' and the surrounding edge 15 of the housing 3, on the printed circuit board 21 an electrically conductive layer 25, preferably in the form of a copper layer 25', and if appropriate an additional layer 26 (see FIGS. 4 and 5) as a refinement layer are provided. This optional layer 26 can consist of a precious metal such as silver or gold or also of tin.

By this arrangement, if a corresponding tightening torque is to be applied to the screws 19, a mechanically firm and thus electrically definite and thus reproducible connection between the electrically conductive layer 25 and the surrounding edge 15 or bearing surface 15 of the housing 3 facing the cover side, that is finally to the housing 3, is produced, in which case the relative flexibility of the printed circuit board 21, i.e. of the board material 121, and the tightening torque of the screws 19 ensure that the electrically conductive layer 25, preferably in the form of the copper layer 25', surroundingly produces and maintains a uniquely defined secure electrical contact to the material of the housing 3. In this way, intermodulation problems conditional on contact are avoided.

Figure 4:
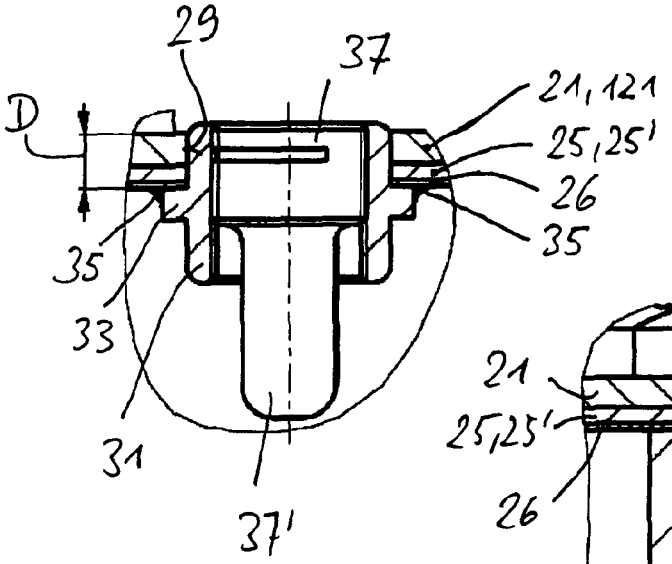
FIG. 4 is an enlarged detailed drawing of the detail X shown in FIG. 1, concerning the tuning element.

As can also be seen in the cross-section and the enlarged detailed drawing according to FIGS. 3 and 4, in the material of the printed circuit board 21 corresponding holes 29 in axial extension of the central axial axis of the inner conductor 7 are provided. A tuning socket, i.e. a tuning sleeve 31, which is electrically conductive at its outer circumference or preferably consists of metal and according to the shown embodiment has a surrounding stop ring 33, can then be inserted into these holes 29, so that a tuning sleeve 31 in this form can be pushed from below into the appropriate hole 29, until the stop ring 33 is in contact with the electrically conductive layer 25. In this position, the surrounding outer edge 33' is preferably soldered to the adjacent electrically conductive layer 25, preferably in the form of the copper layer 25', the thus formed soldered joint, i.e. the thus formed solder ring, being identified in FIGS. 3 and 4 by reference symbol 35.

Then, into the tuning socket 31, which is mechanically connected to the printed circuit board 21 and galvanically connected to the electrically conductive layer 25, a corresponding tuning element 37 with an outer thread can be screwed in to different distances, so that the tuning stub 37', which projects to different distances into the interior, can end at different distances from the inner conductor, i.e. the upper side 7*a* (FIG. 1) of the inner conductor 7.

In contrast, in the shown embodiment, the inner conductor is even provided with a greater diameter and with an axial inner recess 7*b* (FIG. 1) which runs from its top face downward via a partial length, so that here the tuning stub 37' can also dip into this inner recess 7*b* if required, in order to achieve a different tuning of the cavity filter. The tuning element 37 with the tuning sleeve 31 and its arrangement in the printed circuit board 21 which forms the cover are reproduced separately in FIG. 4 as an enlarged detailed drawing X.

Figure 5:
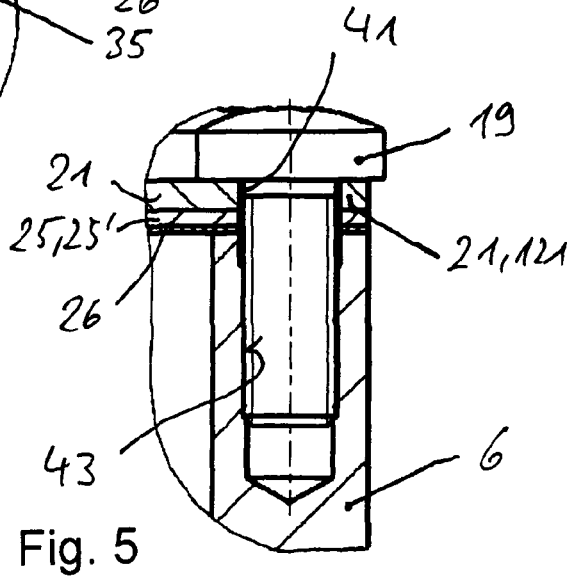
FIG. 5 is an enlarged detailed drawing of the detail Y in FIG. 3, to clarify the screwing of the cover to the housing of the cavity filter.

In the enlarged detailed drawing Y according to FIG. 5, it can also be seen that on the printed circuit board 21, on the outer circumference, offset from each other, there are multiple fixing holes 41, which align with corresponding holes 43, which are incorporated in the housing wall material 6 parallel to the axial alignment of the inner conductor and thus perpendicularly to the plane of the printed circuit board 21. These holes 43 can be provided with a corresponding inner thread which fits the screws 19 which are used, or otherwise be dimensioned so that corresponding fixing screws 19 can nick themselves into the housing wall material 6 of the housing 3 when they are screwed into the holes 43.

Finally, it is noted that the electrically conductive layer 25, that is the mass surface which is preferably in the form of a copper layer 25' plus an additional layer 26 which may be possible, and which acts as refinement and for example can consist of silver, gold or tin or can include these materials, and which mass surface completely seals the coaxial resonator, e.g. the balun or cavity resonator on the top of the housing 3, is a basic part of the balun or cavity resonator, i.e. of the coaxial resonator, or in general of the cavity filter.

Finally, it is also noted that, for example, in particular on the top of the printed circuit board 21, i.e. on the outer or top side 21*b* opposite the interior 1', electrical functions can be implemented, e.g. direct current (DC) lines, etc. Similarly, electronic components could be provided on the printed circuit board, e.g. SMT components, which are positioned and electrically contacted on the printed circuit board according to the known surface mounted technology, in an SMT population procedure. Finally, however, additional devices to achieve or avoid HF overcoupling etc. can also be provided.

Purely as a precaution, it is noted that corresponding structures as explained above can also be provided, alternatively or additionally, on the underside or inside 21*a* of the mass surface, by certain tracks being formed by forming thin conductive portions, e.g. omitted (or removed) by etching procedures. If required, at these places on the top or outside 21*b* of the printed circuit board 21, additional metal surfaces can be formed. Additionally, metallisations in holes (vias) and outer edges (edge metallisation) are possible.

The printed circuit board 21 and/or the printed circuit board material 121 can consist of all suitable and normal materials, i.e. dielectric materials. As the printed circuit board material, printed circuit boards such as are offered, for example, under the names "FR1", "FR2", "FR3", "FR4" or, for example, "FR5", which are commercially known, are considered. The abbreviation "FR" is known to stand for "flame retardant". Such printed circuit board materials can therefore consist of or include the following materials, also in any combination: phenolic resin, paper, epoxy resin, glass fibre, glass fibre fabric, ceramic, PTFE (polytetrafluoroethylene—Teflon).

For better understanding of the advantages according to the invention compared with the prior art, we also refer to the tabular overview reproduced below. It reproduces the so-called modulus of elasticity and the bending resistance, both in N-mm$^2$, for a copper foil, a glass fibre epoxy printed circuit board material and a housing cover according to the prior art of AlMg3, e.g. with the following mean values, which are common in practice, and which can deviate without problems up or down by, for example, up to ±60%, if required also at least up to ±50%, ±40%, ±20% or at least up to ±10%, from the following mean values.

| | Modulus of elasticity (N/mm$^2$) | Bending resistance (N/mm$^2$) |
|---|---|---|
| copper foil | 120,000 | ~280 |
| glass fibre epoxy | 22,000 | 350-450 |
| AlMg3 | 70,000 | 230-290 |

As is known, the amount of the modulus of elasticity is greater the more a material resists deformation. A component of a material with high modulus of elasticity (e.g. steel) is therefore rigid, a component of a material with low modulus of elasticity (e.g. rubber) is flexible.

The actual "softness" of the copper (Cu) foil provided within the invention is explained because by the distribution of the various material thicknesses—although the modulus of elasticity of the copper foil is somewhat higher compared with the material (AlMg3)—a higher "softness" is achieved than in the case of the prior art.

For example, the thickness of the copper on the glass fibre epoxy printed circuit board layer, for example, is only 0.35 μm, whereas if a resonator cover is used according to the prior art, for example consisting of AlMg3, its total thickness is about 1.5 mm. An additional effect is achieved by the combination of copper and glass fibre epoxy if, because of the relatively high bending resistance (rigidity) of the glass fibre epoxy material, a higher contact pressure of the copper layer below it with the filter housing, compared with a cover consisting purely of AlMg3, is achieved.

The invention claimed is:

1. HF cavity filter comprising:

a housing with a housing floor and a housing wall which rises from the housing floor, and at least one inner conductor which is arranged in the interior of the housing, wherein the housing with the housing floor and the housing wall and the inner conductor consist of metal, a housing cover is placed on a surrounding edge of the housing wall, the housing cover has multiple fixing holes, which align with corresponding holes in the housing wall, the housing cover seals the housing, in which multiple fixing screws, which penetrate the fixing holes in the housing cover and are screwed into holes which are axially aligned to it in the housing wall of the housing, the housing cover consists of a dielectric board material, which under the effect of the fixing screws is at least slightly deformable, on the underside of the dielectric board material facing the interior of the housing and thus the edge of the housing wall facing away from the housing floor, an electrically conductive layer is formed, and rests mechanically firmly on the edge under the effect of the fixing screws, and is contacted galvanically with the electrically conductive edge of the housing, wherein:

the housing cover consists of a printed circuit board, at least one additional hole is made in the printed circuit board, into which a tuning socket is inserted, which on its outer circumference, in sections or surrounding it, includes a stop ring, which in the fitted state rests on the electrically conductive layer, the tuning socket, which consists of electrically conductive material, or is provided with an electrically conductive surface, being soldered to the electrically conductive layer, in the region of the stop ring, the tuning element can be twisted into the tuning socket to different distances, on the printed circuit board, at least one electrically conductive structure is formed, and the dielectrically conductive structure includes at least one track and/or at least one SMT component and/or at least one HF overcoupling device.

2. HF cavity filter according to claim 1, wherein the printed circuit board has a thickness of less than 5 mm.

3. HF cavity filter according to claim 1, wherein the thickness of the printed circuit board is greater than 0.1 mm.

4. HF cavity filter according to claim 1, wherein the electrically conductive layer has a thickness between 1 pm to 300 pm.

5. HF cavity filter according to claim 1, wherein the thickness of the electrically conductive layer is less than 20%, and/or that the thickness of the electrically conductive layer is more than 0.1%.

6. HF cavity filter according to claim 1, wherein the electrically conductive layer consists of a copper layer, which is provided on the contact side with an additional layer, which includes and consists of one or more of the following materials: silver, gold or tin.

7. HF cavity filter according to claim 1, wherein at least one structuring device is formed on the outside or top of the printed circuit board.

8. HF cavity filter according to claim 1, wherein at least one structuring device is formed partly or entirely on the inside or underside facing the interior of the HF cavity filter.

9. HF cavity filter according to claim 1, wherein the printed circuit board material is composed of one or more of the following materials: phenolic resin, paper, epoxy resin, glass fibre, glass fibre fabric, ceramic, PTFE.

10. HF cavity filter according to claim 1, wherein the housing has with side wall sections and boundary walls forming chambers, and consists of metal or a metal alloy, in the formed of a milled part or casting.

* * * * *